United States Patent [19]

Spector

[11] Patent Number: 4,828,527

[45] Date of Patent: May 9, 1989

[54] PLAY CHARACTER

[76] Inventor: Donald Spector, 380 Mountain Rd., Union City, N.J. 07087

[21] Appl. No.: 128,887

[22] Filed: Dec. 4, 1987

[51] Int. Cl.[4] ..... A63H 3/33

[52] U.S. Cl. ..... 446/302; 446/219

[58] Field of Search ..... 446/219, 297, 299, 302, 446/408, 72, 76, 404, 484, 485

[56] References Cited

U.S. PATENT DOCUMENTS

| | | | |
|---|---|---|---|
| 2,309,542 | 1/1943 | Rothberg | 446/302 X |
| 3,080,679 | 3/1963 | Hardigan | 446/302 |
| 3,614,110 | 10/1971 | Marshall et al. | 446/302 X |
| 4,521,205 | 6/1985 | Spector | 446/219 X |
| 4,654,659 | 3/1987 | Kubo | 446/229 X |

FOREIGN PATENT DOCUMENTS

| | | | |
|---|---|---|---|
| 0214013(A) | 3/1987 | European Pat. Off. | 446/297 |
| 2133951(A) | 8/1984 | United Kingdom | 446/302 |

*Primary Examiner*—Robert A. Hafer
*Assistant Examiner*—Sam Rimell
*Attorney, Agent, or Firm*—Michael Ebert

[57] ABSTRACT

A three-dimensional play character provided with translucent eye and mouth elements, the character having fixedly mounted within its body a pre-recorded microcassette which is accessible through a body opening, the recorded sounds being appropriate to the personality of the character. Within the body are light guides that run from an optical inlet on the wall of the opening to the eye and mouth elements. Insertable through the opening to occupy an operative position with respect to the microcassette is a battery-powered playback module that serves to drive the microcassette, the module including a pick-up heat coupled to an audio amplifier whose audio signals are applied both to a loudspeaker which reproduces the recording and to a light bulb that is modulated by the signals to produce light pulses in synchronism with the reproduced sounds. The light bulb, when the module is in its operative position, lies adjacent the optical inlet whereby the light pulses are conveyed by the guides to the eye and mouth elements to impart animation thereto in synchronism with the sounds emitted by the character. The module is removable and is usable with a family of different characters each having a pre-recorded microcassette therein whose recording is appropriate only to that character.

5 Claims, 2 Drawing Sheets

Fig. 1.
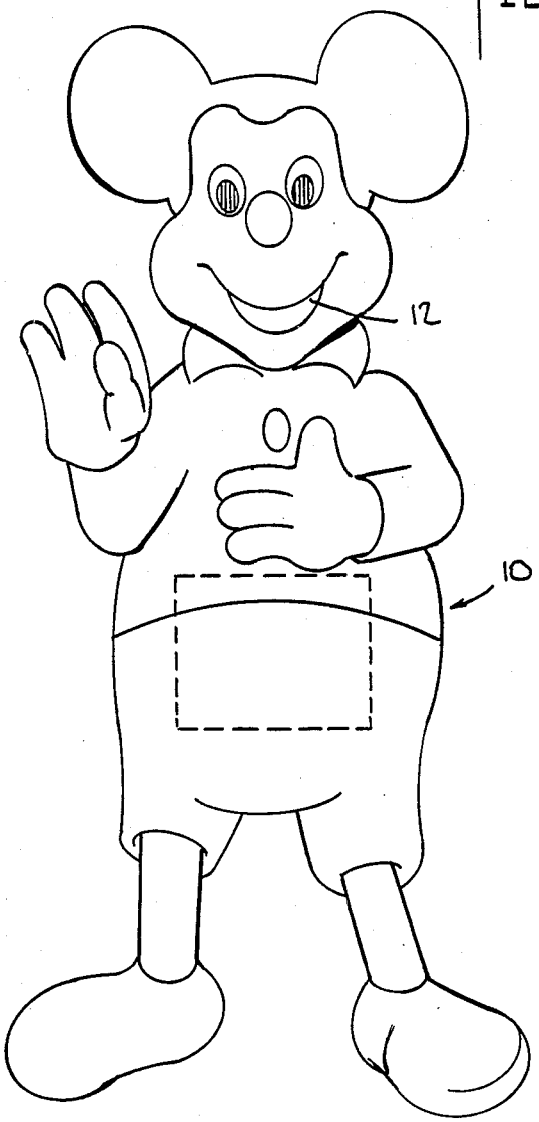
Fig. 2.
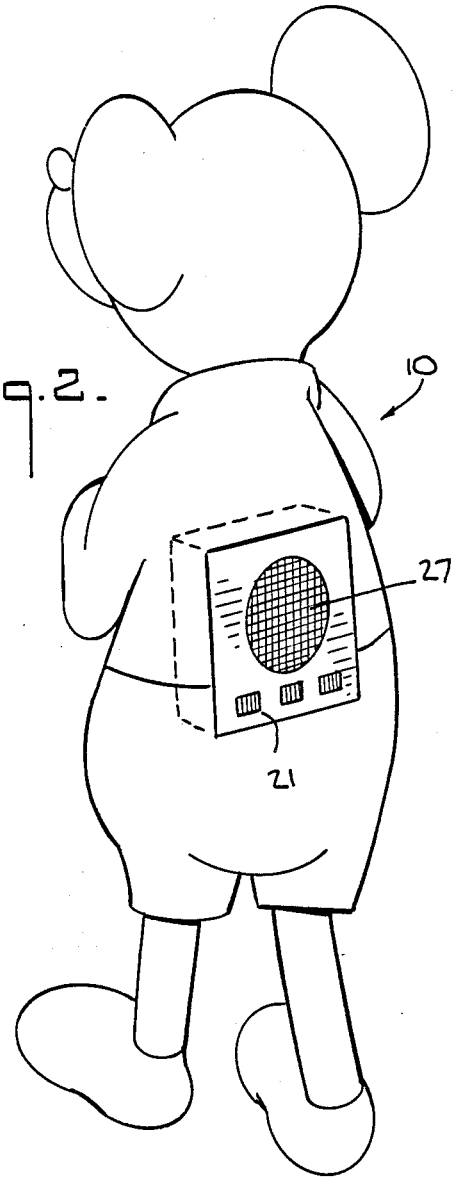
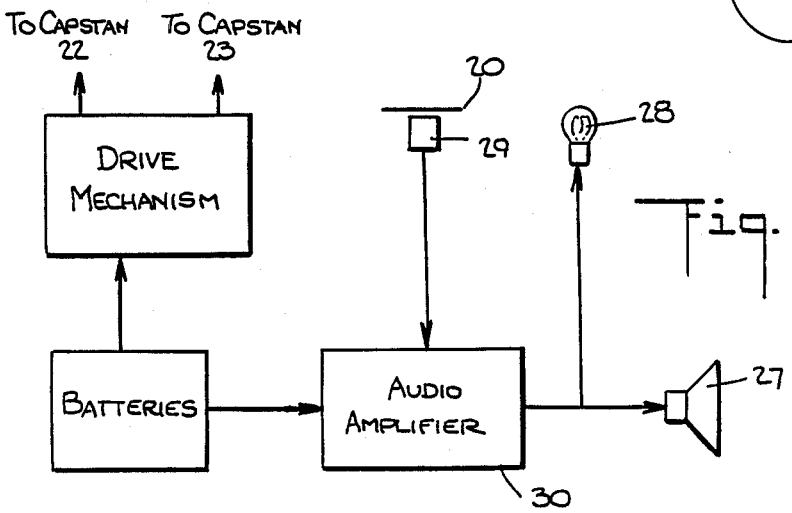
Fig. 7.

PLAY CHARACTER

BACKGROUND OF INVENTION

1. Field of Invention:

This invention relates generally to play characters which sing or speak and which appear to be animated in accordance with the emitted sounds, and more particularly to a character of this type whose body has incorporated therein a prerecorded microcassette that records a story, a song or other vocal material appropriate to the personality of the character, the recording being played back by a module insertable into the body of the character to a position in operative relation to the microcassette, the module emitting light pulses in synchronism with the sounds, the pulses being conveyed to mouth and eye elements in the character to impart animation thereto.

2. Prior Art:

The term "character" ordinarily refers to a person in the cast of a drama or novel. But as the term is now popularly employed in the field of toys and playthings, it applies to a humanoid or animal-like figure that originated in a comic strip, a motion picture or TV presentation and has acquired the status of a recognized personality. Thus Donald Duck and Mickey Mouse are internationally known characters, as are the figures who populate the Sesame Street TV series for children.

Each such established character is recognizable not only by his unique appearance but also because of its voice. For example, Mickey Mouse speaks with a squeeky voice appropriate to a mouse, whereas Donald Duck's voice is a cross between a duck's quack and human speech. If, therefore, one were to incorporate a pre-recorded magnetic tape player in a Donald Duck character, unless this recording simulated the familiar voice of Donald Duck, it would sound incongruous.

Characters are presently available on the market which incorporate a player operating with a prerecorded magnetic tape, so that the character gives the impression that it is talking in its normal voice. In some instances, means are also provided to mechanically manipulate the lips of the character to enhance this impression.

There are two practical drawbacks to such known animated talking characters. The first objection is the matter of cost; for the inclusion of a tape recording player in the character adds substantially to the expense of producing such a character and effectively prices it out of the reach of many potential customers. Another objection is that even though the mouth appears to talk, the lip movements are predetermined and unrelated to what is being spoken or sung by the character, and therefore is lacking in verisimiltude.

My prior patent U.S. Pat. No. 4,521,205 discloses a three-dimensional character that is united with a prerecorded magnetic tape cartridge or cassette which plugs into a tape player. The character in my prior patent is provided with eye and mouth openings covered by translucent elements coupled by internal light guides to a common optical inlet. When the cassette is plugged into the player to effect playback, the character is then in an erect position above the player which acts as a stage for the character. In this position, the optical inlet is then in registration with a light outlet whose bulb is energized by the audio output of the player. As the recorded sound is reproduced by a loudspeaker, the light emitted by the bulb is modulated to produce light pulses which are conveyed by the light guides to the eye and mouth elements to impart animation to the character in synchronism with the reproduced sounds.

The advantage of my patented arrangement is that one may provide a family of different characters each united with a pre-recorded magnetic tape cassette whose recording is appropriate to the personality of the character, and a single player common to all of the characters, thereby obviating the need for incorporating a player in each character.

However, this patented arrangement also has certain drawbacks; for in order to unite cassette to the character, the lower portion including the legs of the character are amputated. Hence a child cannot cuddle or play with this character as he would with an ordinary character or doll, for a significant portion of the character is sacrificed to permit the character to be joined to the cassette. Moreover, the cassette is exposed; and since children tend to give play characters rough treatment, it may in time become damaged and unplayable.

SUMMARY OF INVENTION

In view of the foregoing, the main object of this invention is to provide a three-dimensional character capable of talking or singing in a voice appropriate to the personality of the character, the character being a full embodiment that includes all normal body members and extremities whereby the character can be cuddled or played with in a manner possible with a conventional play character incapable of talking or singing.

More particularly, an object of the invention is to provide a play character of the above type which incorporates within its body a pre-recorded microcassette, the character being usable with a removable playback module that is insertable through an opening in the body of the character to a position in operative relation to the cassette.

A significant feature of the invention is that the same playback module may be used with a family of different characters each having a microcassette incorporated therein whose recording is appropriate only to that character.

Also an object of the invention is to provide a playback module which includes a light output whose bulb is responsive to the reproduced audio signals to produce light pulses which are transmitted by light guides housed in the character to translucent eye and mouth elements in the character to impart animation thereto which is synchronized with the signals.

Briefly stated, these objects are attained in a three dimensional play character provided with translucent eye and mouth elements, the character having fixedly mounted within its body a pre-recorded microcassette which is accessible through a body opening, the recorded sounds being appropriate to the personality of the character. Within the body are light guides that run from an optical inlet on the wall of the opening to the eye and mouth elements. Insertable through the opening to occupy an operative position with respect to the microcassette is a battery-powered playback module that serves to drive the microcassette, the module including a pick-up head coupled to an audio amplifier whose audio signals are applied both to a loudspeaker which reproduces the recording and to a light bulb that is modulated by the signals to produce light pulses in synchronism with the reproduced sounds. The light bulb, when the module is in its operative position, lies adjacent the optical inlet whereby the light pulses are conveyed by the guides to the eye and mouth elements to impart animation thereto in synchronism with the sounds emitted by the character. The module is removable and is usable with a family of different characters each having a pre-recorded microcassette therein whose recording is appropriate only to that character.

BRIEF DESCRIPTION OF DRAWINGS

For a better understanding of the invention as well as other objects and further features thereof, references is made to the following detailed description to be read in conjunction with the accompanying drawings, wherein:

FIG. 1 is a perspective view of one embodiment of a character in accordance with the invention;

FIG. 2 is a rear view of the character showing the playback module plugged therein;

FIG. 3 is a rear view of the character with the playback module withdrawn therefrom to expose the microcassette held within the body of the character;

FIG. 7 is a block diagram of the playback module.

DESCRIPTION OF INVENTION

Figure 6:
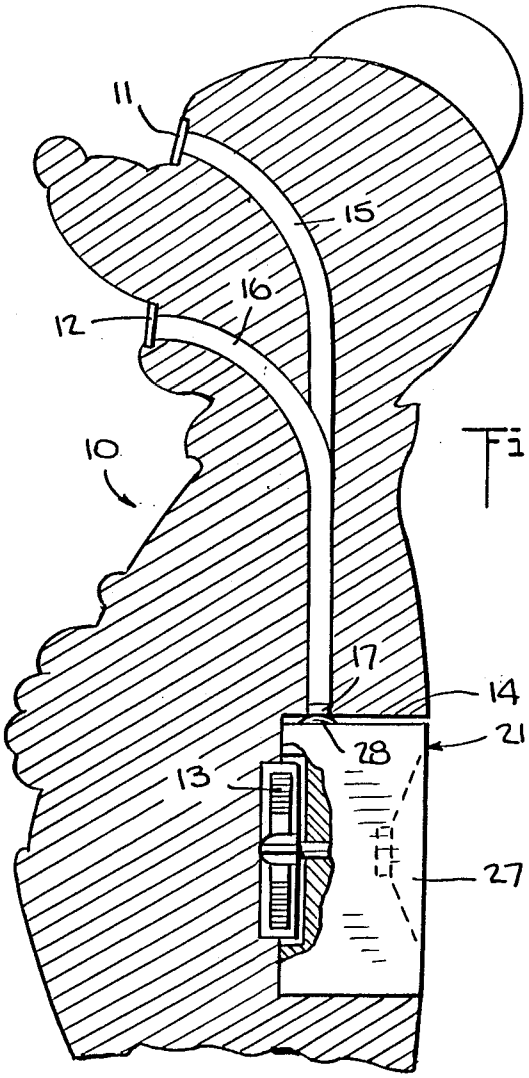
FIG. 6 is a longitudinal section taken through the character showing the relationship of the microcassette to the plugged-in playback module.

Referring now to FIGS. 1 and 2, there is shown an animated character in accordance with the invention, generally designated by reference numeral 10, the character shown by way of example being somewhat similar to the familiar Mickey Mouse and having enlarged ears, hands and feet and a smiling mouth. The character is preferably formed with a soft body so that it can be cuddled and otherwise played with by a young child. The character is provided with a pair of eye openings, each covered by a translucent plastic element or lens 11. The character also has a mouth opening covered by a translucent plastic element 12.

As shown in FIG. 3, incorporated at a fixed position in the body of the character is a microcassette 13, access thereto being had by way of a body opening 14 whose entry is at the rear of the body. The microcassette 13 is shown separately in FIG. 5. As best seen in FIG. 6, the eye and mouth elements 11 and 12 of the character are optically coupled by a pair of integral light guides 15 and 16 to a common optical inlet 17 placed at the side of opening 14. In practice, these light guides may be formed of flexible fiber cables or acrylic light pipes having light conducting properties by reason of multiple internal reflections, such as those now commonly used to illuminate light indicators on automobile dashboards.

In a magnetic tape sound system operating in the recording mode, the audio signal to be recorded is applied to the coil of a recording head, and as the tape is advanced across the head at a constant speed, magnetization is induced in the tape in proportion to the current flowing through the coil. In the playback mode, as the tape advances at the same speed across a reproducing head, flux from the tape intercepts the pick-up coil of the head, the flux variations in the tape inducing an emf in the coil which is amplified and reproduced in a loudspeaker.

Figure 5:
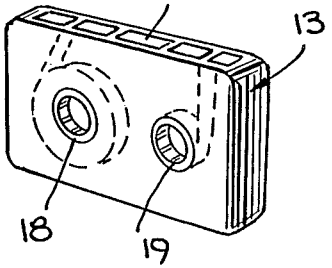
FIG. 5 is a separate view of the microcassette.
Figure 9:
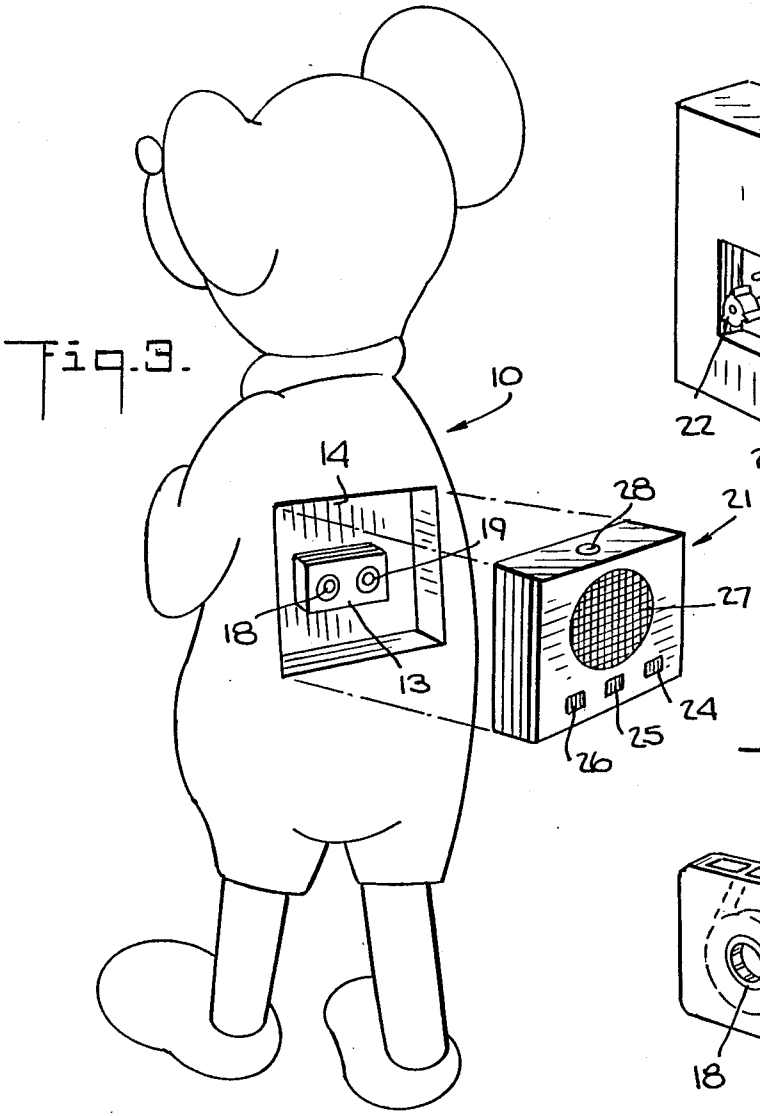

The present invention makes use of a pre-recorded tape in a microcassette format having recorded thereon the voice of the character in which the microcassette 13 is incorporated. The microcassette, as shown in FIG. 5, includes a pair of reels 18 and 19, the tape being wound on one reel which serves as a supply reel, and being transferred in the course of playback to the other reel which functions as the pickup reel. In order, therefore, to replay the tape after it has been played, the tape must first be rewound so that it is transferred back from the pickup to the supply reel. The tape is so threaded that a flat portion 20 thereof is exposed along one side of the cassette so that it can be engaged by the reproducing head.

Figure 4:
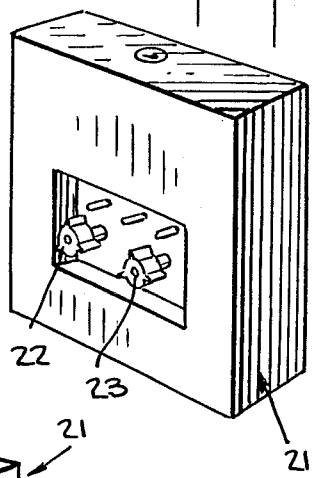
FIG. 4 is a separate view of the playback module which is used in conjunction with the character.

Pluggable into opening 14 in the rear of character 10 is a playback module which, as shown in FIGS. 4, 5 and 6, is adapted to cooperate with microcassette 13 to play back and reproduce the tape recording. Module 21 is provided with capstans 22 and 23 which when the module is plugged in, engage reels 18 and 19 of the microcassette, so that in opera ton one reel is driven to unwind the tape therefrom to pass across a playback head, while the other reel rotates to wind up the tape in a manner conventional in tape players. Module 21 is provided with the usual control buttons such s a "PLAY" button 24, a FAST FORWARD button 25 and a REWIND button 26 as well as a loudspeaker 27 to reproduce the played back tape recording. The loudspeaker is placed at the rear of the module so that it is exposed when the module is plugged in.

The audio signal applied to loudspeaker 27 is also fed to a light bulb 28 which is modulated by these signals to produce light pulses in synchronism with the reproduced voice sounds. Light bulb 28 is mounted on the case of the playback module 21 at a position thereon such that when the module is plugged in, as shown in FIG. 6, the bulb is then in registration with the optical inlet 17. Hence the light pulses produced by the light bulb are conveyed by light pipes 15 and 16 to the translucent elements covering the eyes and mouth of the character in synchronism with the sounds emitted by the character.

As shown by the block diagram in FIG. 7, except for light bulb 28, the playback module has the standard component of a magnetic tape player. It includes a magnetic pick-up head 29 across which the magnetic tape 20 in the microcassette is drawn to generate audio signals which are applied to an amplifier 30. The output of amplifier 30 is fed to loudspeaker 27 as well as to light bulb 28. Also provided is a drive mechanism 31 for capstans 22 and 23, the drive mechanism and amplifier 30 being powered by replaceable batteries 32. In practice, the module may be provided at its rear with a handle to facilitate plugging in or withdrawing of the module. No cassette eject mechanism as in a conventional tape player is required.

Thus in the example illustrated, the Mickey Mouse character 10 has permanently incorporated in its body a microcassette 13 which carries a tape recording in Mickey Mouse's familiar voice. This recording can be in the form of spoken messages or songs which are reproduced when the playback module is plugged in to engage and operate the microcassette.

Nor only does the child who holds the Mickey Mouse character hear Mickey Mouse singing or talking in his familiar voice, but at the same time the eyes and mouth of Mickey Mouse because of the flickering light effects which are synchronized with the voice, impart animation to the character.

The same playback module can be used with other characters which incorporate cassettes whose recordings are appropriate to the respective voices of the character. Hence a child may be provided with a family of different characters and a single playback module which can be plugged into any of the characters. The bodies of these characters are preferably of stuffed or soft construction; hence the player may cuddle or baby the characters.

While there has been shown and described a preferred embodiment of a PLAY CHARACTER in accordance with the invention, it will be appreciated that many changes and modifications may be made therein without, however, departing from the essential spirit thereof.

I claim:

1. A three-dimensional play character adapted to produce sounds in a voice appropriate to the character and to appear to be animated when the character is speaking or singing, said character comprising:

A. a body provided with legs and other appendages to create a full embodiment of the character and having a head attached thereto in a configuration appropriate to the character, said body having at its rear an open cavity, said head having a mouth opening by a translucent element;

B. an internal light pipe extending from an optical inlet at a side of the cavity to said translucent element to convey light thereto;

C. a pre-recorded magnetic tape cassette secured at a fixed position within said cavity, the recording being in a voice appropriate to the character; and D. a battery-operated playback module pluggable into the cavity to engage and operate the cassette to play back and reproduce the recording, said module being provided with a light bulb which is caused to produce light pulses in synchronism with the played back voice and is positioned in registration with the optical inlet when the module is plugged in, whereby the light pulses are conveyed to the translucent element mouth to impart animation to the character as the character speaks or sings, the same module being usable with different characters each provided with a cassette having a voice recording appropriate thereto, said module further including an amplifier, a loudspeaker and a playback head which when the module is plugged into the cavity, the playback head then lies in operative relation to the cassette tape to yield audio signals that are amplified in said amplifier and applied to said loudspeaker as well as to said light bulb, said loudspeaker being at the rear of the module to direct sound rearwardly when the module is plugged in.

2. A character as set forth in claim 1, wherein said cassette is a microcassette having a pair of reels, and said module includes a pair of capstans which engage the reels.

3. A character as set forth in claim 2, wherein said module includes a drive mechanism for the capstans.

4. A character as set forth in claim 1, wherein said head is also provided with eye openings covered by translucent eye elements which are coupled by light pipes to said optical inlet whereby the eyes as well as the mouth are animated.

5. A character as set forth in claim 1, wherein said bulb is connected to the output of the amplifier.

* * * * *